United States Patent [19]

Thomas et al.

[11] 4,280,877

[45] Jul. 28, 1981

[54] APPARATUS FOR PROVIDING COAL DUST TO A REACTION CHAMBER

[75] Inventors: Gerhard Thomas; Richard Jung, both of Gummersbach, Fed. Rep. of Germany

[73] Assignee: L. & C. Steinmüller GmbH, Gummersbach, Fed. Rep. of Germany

[21] Appl. No.: 81,766

[22] Filed: Oct. 4, 1979

[30] Foreign Application Priority Data

Oct. 7, 1978 [DE] Fed. Rep. of Germany ..... 2843883

[51] Int. Cl.[3] ..... C10B 15/00; C10B 29/00; C10B 31/02; F27B 1/20

[52] U.S. Cl. ..... 202/91; 48/76; 48/DIG. 4; 201/33; 201/37; 202/117

[58] Field of Search ..... 201/17, 32, 33, 37, 201/42; 202/91, 117; 48/76, 203, 206, DIG. 4

[56] References Cited

U.S. PATENT DOCUMENTS

| | | | |
|---|---|---|---|
| 1,739,786 | 12/1929 | Dieterle | 48/DIG. 4 X |
| 1,913,237 | 6/1933 | Hillebrand | 48/206 |
| 2,621,117 | 12/1952 | Garrison | 48/DIG. 4 X |
| 2,670,280 | 2/1954 | Totzek | 48/206 |
| 2,829,957 | 4/1958 | Carkeek | 48/206 |
| 2,913,321 | 11/1959 | Rummel | 48/203 X |
| 3,110,578 | 11/1963 | Severson et al. | 48/203 |

*Primary Examiner*—Bradley Garris

*Attorney, Agent, or Firm*—Becker & Becker, Inc.

[57] ABSTRACT

A method of and apparatus for providing coal dust to a reaction chamber, especially in the process of producing low-sulfur coke dust and gas by gas extraction and partial gasification of coal dust in a reaction chamber for partially combusting coal dust. Coal dust and a first stream of combustion gas are combined and passed through a central conduit to a reaction chamber. A second stream of combustion gas can be selectively subjected to swirling motion and can be combined with the stream emanating from the central conduit. The degree of swirl of the first stream and the second stream of combustion gas is used to control distribution of the gas-solids mixture in the reaction chamber and to control the path of the gas-solids mixture leading into the wall of the reaction chamber.

4 Claims, 6 Drawing Figures

APPARATUS FOR PROVIDING COAL DUST TO A REACTION CHAMBER

The present invention relates to a method of an apparatus for providing coal dust to a reaction chamber, especially in the process of producing low-sulfur coke dust and gas by gas extraction and partial gasification of coal dust in a reaction chamber, which reaction chamber has means for partially combusting coal dust in a quantity sufficient to satisfy heat requirements for gas extraction and partial gasification of the coal dust.

In the process of producing coal dust low in sulfur and gas by gas extraction and partial gasification of coal dust in a reaction chamber, it is necessary for attaining the main objective, namely the removal of sulfur, at least in part, from the coal dust, to subject the coal dust in the reaction chamber to the pertaining treatment, whereby the coal dust is substantially free of strands or free flowing in the reaction chamber. Investigations have shown that in the zones of such bands or strands (Strähnen), due to the concentration of the coal dust, its heating and reaction with the gaseous components are retarded and, accordingly, at a predetermined residence time in the reaction chamber, the degree of sulfur removal is reduced. Furthermore, the coal dust particles remain in a state in which they are liable to cake or sinter on impinging on the chamber walls due to the delay in attaining the proper temperature and, accordingly, this may lead to substantial contamination or clogging which affects the proper operation of the process.

It is, accordingly, an object of the present invention to provide a method in which a proper distribution of the coal dust at the entry or inlet and within the combustion chamber is assured.

It is also an object of the invention to provide an apparatus for carrying out the method of the invention.

These objects and other objects and advantages of the invention will appear more clearly from the following specification in connection with the accompanying drawings, in which.

Figures 1, 2:
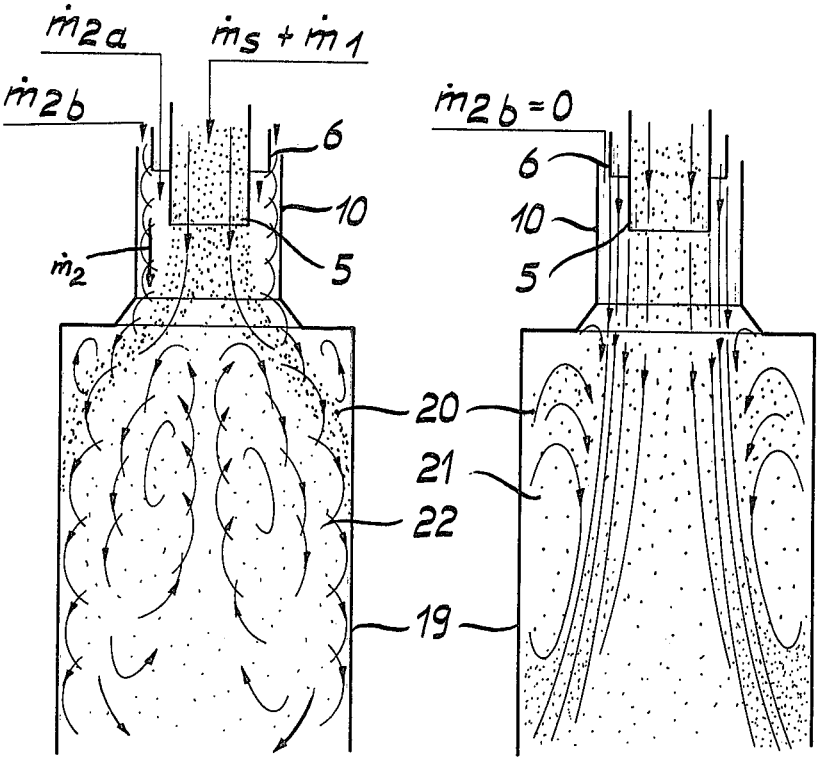
FIG. 1 is a diagrammatic representation of the flow behavior of the stream of a solid-gaseous mixture introduced into a reaction chamber, whereby a part of the carrier gas is introduced with a swirling motion and whereby within the chamber there is formed a flow with marked inner and only little outer recirculation.
FIG. 2 is a diagrammatic representation of the flow behavior of a solid-gas mixture introduced into the reaction chamber with swirl-free introduction of the entire gas stream whereby a flow with outer recirculation is formed.

The present invention is characterized primarily therein that a method is provided in which the coal dust stream, in a first stage, is uniformly distributed in a first partial stream of combustion air or gas, which is guided towards the coal dust stream, with the coal dust being uniformly distributed over the common flow cross section by means of swirling or agitating motion imparted on the first combustion air stream.

The method in accordance with the present invention is further characterized primarily therein that a second stage is provided in which the stream comprised of coal dust and a first partial stream of combustion air is mixed with a second stream of combustion air which is selectively agitated or subjected to swirling and which is surrounding the stream comprised of coal dust and a first stream of combustion air, with the resulting stream being introduced into the reaction chamber. The design of twist or swirl is used to control the distribution of the produced solid-gaseous mixture, at least in the reaction chamber, and the flight path of the solid dust particles until impingement upon the chamber wall while avoiding or preventing solid strands, strings, or bands of solid particles.

An apparatus in accordance with the present invention for carrying out the method of the invention is characterized primarily therein that a first duct or tube is provided having at least one laterally communicating further duct or tube, a cylindrical vessel which coaxially surrounds the first duct, which vessel is closed at the top and has a lowermost end which is reduced conically in downward direction towards the reaction chamber. This vessel furthermore is provided with an inlet for the combustion air. The apparatus further includes a central conduit which forms an extension of the vessel in downward direction, the central conduit being coaxial to the first duct or tube. Furthermore, there is provided an intermediate conduit which is coaxial to the central conduit and in communication, by means of a conical widening, with one compartment of a housing which housing is upwardly closed and which includes a duct or conduit, and a partition in the duct, whereby the second stream of combustion air or gas can pass through the duct, the compartment of the housing and through the annular chamber provided between the central conduit and the intermediate conduit, which air stream is not subjected to agitation or a swirling motion. The bottom end of the intermediate conduit terminates further away from the reaction chamber than the bottom end of the central conduit. A further conduit is provided which, in turn, coaxially surrounds the intermediate conduit, with the upper end of the further conduit being conically widened and in communication with a second compartment of the housing which is upwardly closed, the second compartment being in communication with a duct in which twist or swirl imparting members are provided near the outer or further conduit. The other end of the further or outer conduit is arranged to communicate with the reaction chamber. The duct for the first compartment, which compartment is in communication with the intermediate conduit, and the duct, which is in communication with the second compartment, which in turn is in communication with the outer conduit, have a common duct section for communicating the first duct and the second duct with a source of combustion gas or combustion air, with at least one rotary lock or flow control means being provided at the junction of the first duct and the second duct. Preferably, there is one rotary lock provided at the junction and a further rotary lock upstream of the first rotary lock.

Figure 3:
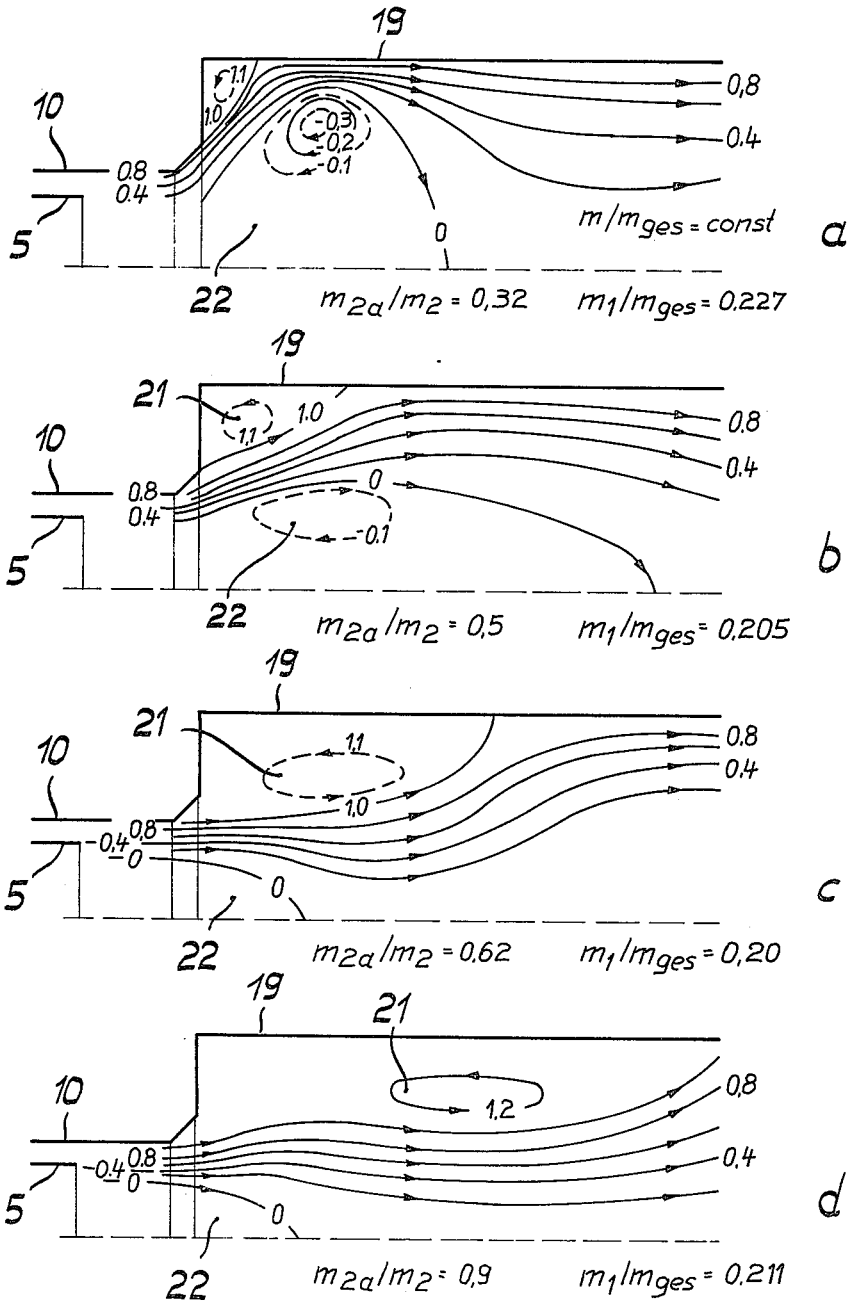
FIG. 3 shows in the flow diagrams a, b, c, and d the effect of the degree of swirl on the flow pattern or form and thus on the expansion of the outer recirculation region, with the views only showing half of the reaction chamber.

Referring now particularly to the drawings, the basic considerations of distributing of a dust-gas stream from a small to a large cross section are described with reference to FIGS. 1 to 3. Here, there is moved the dust stream $m_s$ with the partial stream $m_1$ of the gas through a central conduit 5 while the balance of the gas is divided into a partial stream $m_{2a}$ which stream is twist-free, through an annular passage between the tubes 5 and 6, and a second partial stream $m_{2b}$ which is agitated or subjected to move in a swirling motion and passed through the annular passage between the conduits 6 and 10. The partial streams $m_{2a}$ and $m_{2b}$ are mixed in the common annular chamber at the outlets of the conduits 5 and 6 and form a common stream $m_2$. Stream $m_2$, of course, is moving with a certain degree of swirl or agitation, which is in conformity with the ratio $m_{2a}/m_{2b}$ and/or $m_{2a}/m_2$. Downstream of the outlet of conduit 5, the dust-gas stream comprised of streams $m_s+m_1$ is mixed with the partial stream of combustion gas or combustion air $m_2$ which surrounds the dust-gas stream.

As indicated in FIG. 1, the twist or swirling movement in the partial stream $m_2$ causes in the interior of the stream or flow a circular movement, designated generally by the numeral 22, in the enlarged portion of the reaction chamber 19. With this, the dust 20 is concentrated in a small border zone.

As is indicated in FIG. 2, when the partial stream of combustion gas $m_2$ is moving without a twist or swirl, i.e. in the case of $m_{2b}=0$, a flow with marked outer recirculation, generally designated by the numeral 21, is produced in the enlarged portion of the reaction chamber 19, whereby the dust, designated generally by the numeral 20, is distributed over the entire cross section of the reaction chamber 19.

Comparison of FIGS. 1 and 2 shows that the flow behavior in the chamber is substantially influenced by the twist or swirling motion of the partial stream of combustion gas $m_2$. The degree of twist or swirling motion, at a constant partial stream $m_1$, is dependent only on the portion of the twist-free partial stream $m_{2a}$ of the total partial stream $m_2$. This relation or dependency is further explained in FIG. 3. Here the propulsion of the twist-free partial stream increases from the view 3*a* towards view d with the degree of twist, accordingly, decreases. When the degree of twist decreases, the outer recirculation flow zone 21 increases while the inner reflow or recirculation zone 22 decreases.

Figure 4:
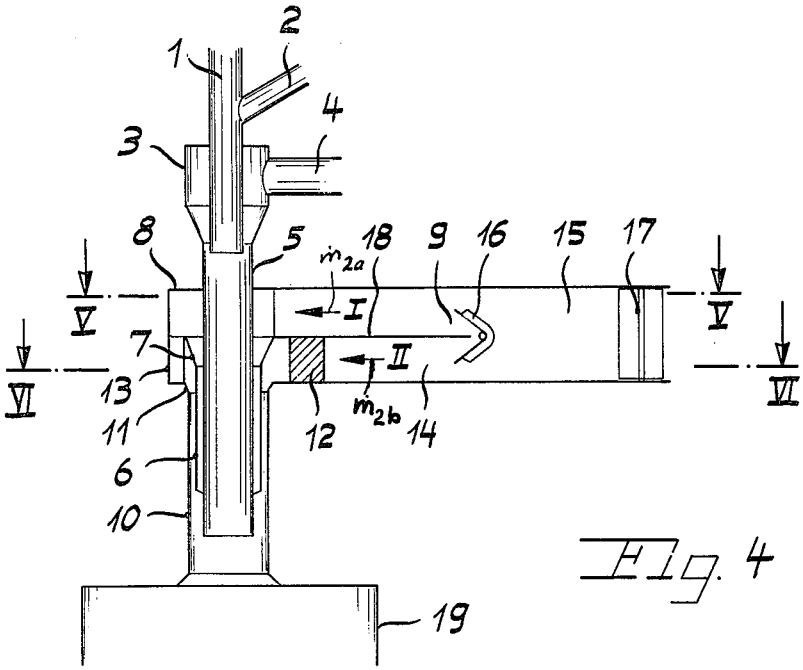
FIG. 4 is a side elevational diagrammatic view of an apparatus in accordance with one embodiment for producing a strand-free coal dust-gas stream.
Figure 5:
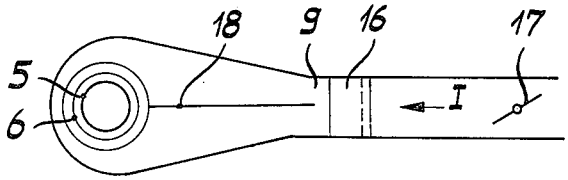
FIG. 5 is a cross section along line V—V in FIG. 4.
Figure 6:
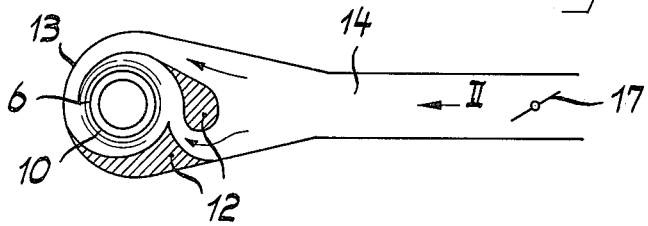
FIG. 6 is a cross section along line VI—VI in FIG. 4.

It is a precondition for the required strand-free or free flowing of the coal dust in the reaction chamber 19 that the coal dust is uniformly distributed over the cross section of the central conduit 5. The steps for maintaining this condition and the opportunity to control the twist are explained in FIGS. 4 to 6. For this, it is assumed, to simplify matters, that the partial streams of the gases are comprised essentially of air.

When operating with pneumatic conveying of coal dust to the reaction chamber 19, the coal dust-first air stream flows through the first or central conduit into the subsequent coaxial central duct or conduit having a larger cross section than the first conduit. Due to the sudden enlargement of the cross section there is formed at the outlet of conduit 1 an annular twist or swirl by means of which the coal dust is uniformly distributed over the cross section of the central conduit 5.

When operating in such a way that coal dust is fed to the system from a bunker or silo, the coal dust flows through the conduit 2 into the conduit 1 and is mixed in the outlet thereof with the first stream of air, this stream being added through inlet conduit 4 and a cylindrical vessel 3. Again in this operational mode, distribution of the coal dust over the cross section of the central conduit 5 is ensured by the annular twist or movement at the outlet end zone of the conduit 1.

Secondary air $m_2$ is admitted through a common channel or conduit 15 and distributed by a rotary lock 16 to the duct 9 for the twist-free secondary air stream $m_{2a}$, and duct 14 for the secondary air stream $m_{2b}$ which is moving with a swirl or twist. The total stream of secondary air $m_2=m_{2a}+m_{2b}$ is controlled by the entry rotary lock 17. The twist-free partial stream $m_{2a}$ is directed through the housing 8 and the conical widening 7 of the concentric conduit 6, and then through the annular passage or chamber between the conduits 5 and 6. The air stream moving with a twist or swirl $m_{2b}$ is passed through a second housing or compartment 13, the conical widening 11 of the outer conduit 10, and then through the annular chamber or passage between the conduits 6 and 10. By means of twist-motion imparting members 12 (FIG. 6) the rotary movement is begun. The vertically disposed partition 18 indicated in FIGS. 4 and 5 serves to prevent rotary movement of the twist-free admitted partial stream $m_{2a}$. Between the outlet region of the conduits 5 and 6 the twist-free partial stream $m_{2a}$ is mixed with the partial stream $m_{2b}$ which is moving with a swirl or twist, and the combined partial stream $m_2$ is subsequently brought together with the central stream comprised of dust and first air stream $m_s+m_1$, whereby the partial stream forms a closed outer mantle. In the reaction chamber 19 then, independent of the partial stream ratio $m_{2a}/m_2$, one of the flow shapes shown in FIGS. 1 to 3 is produced.

The present invention is, of course, in no way restricted to the specific disclosure of the specification and drawings, but also encompasses any modifications within the scope of the appended claims.

What we claim is:

1. An apparatus for introducing a combustion gas and coal dust to a reaction chamber, said apparatus comprising:

a cylindrical vessel having a closed top and a conical bottom directed towards said reaction chamber;

at least one first conduit means, operatively connected to said vessel, for communicating a source of coal dust and said cylindrical vessel with one another, said vessel coaxially surrounding at least a portion of said at least one first conduit means;

second conduit means, operatively connected to said vessel, for communicating a first stream of combustion gas and said cylindrical vessel with one another;

a central conduit means, operatively connected to said vessel coaxial therewith and forming an extension of said conical bottom thereof, and having an end directed towards said reaction chamber for conveying coal dust and a first combustion gas from said cylindrical vessel toward said reaction chamber;

a third conduit means operatively connected to said central conduit means and said reaction chamber for conveying to said reaction chamber at least one second stream of combustion gas; and means operatively arranged in said second conduit means and located for imparting a swirling motion to part of said second stream of combustion gas;

said third conduit means including;

a housing divided into a first and a second compartment and arranged between said cylindrical vessel and said reaction chamber for receiving at least part of said second stream of combustion gas in said first compartment;

a first duct means operatively connected to said housing for admitting to said first compartment at least part of said second combustion gas stream;

a second duct means operatively connected to said housing for communicating said second compartment with a second combustion gas stream source;

means for imparting a swirl to part of said second combustion gas stream;

an intermediate conduit coaxially surrounding said central conduit means to form therewith a first annular passageway for combustion gas being passed from said first compartment to said reaction chamber, said intermediate conduit having a first end and a second end, said first end being conically widened, operatively connected to said housing, and in communication with said first compartment, said second end of said intermediate conduit being directed towards said reaction chamber and being further away from said reaction chamber than that end of said central conduit means which is directed towards said reaction chamber; and an outer conduit coaxially surrounding said intermediate conduit to form therewith a second annular passageway for combustion gas being passed from said second compartment to said reaction chamber, said outer conduit having a first end and a second end, said first end being conically widened, operatively connected to said housing, and in communication with said second compartment, said second end of said outer conduit being operatively connected to said reaction chamber.

2. An apparatus according to claim 1, and further comprising:

a vertically disposed partition longitudinally dividing said first duct means at least in the vicinity of said intermediate conduit; and said means for imparting swirl is operatively arranged in said second duct means near said outer conduit.

3. An apparatus according to claim 1, wherein said first duct means and said second duct means include a common duct section for communicating said first duct means and said second duct means with a source of second combustion gas.

4. An apparatus according to claim 3, and further comprising at least one flow control device in said common duct section.

* * * * *